US006506316B1

(12) United States Patent
Wahle et al.

(10) Patent No.: US 6,506,316 B1
(45) Date of Patent: Jan. 14, 2003

(54) WATERPROOFING AGENTS FOR TEXTILE FINISHING

(75) Inventors: Bernd Wahle, Kaarst (DE); Ludwid Boenniger, Kempen (DE); Wolfgang Tuerk, Krefeld (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 09/856,674

(22) PCT Filed: Nov. 19, 1999

(86) PCT No.: PCT/EP99/08886

§ 371 (c)(1),
(2), (4) Date: Sep. 17, 2001

(87) PCT Pub. No.: WO00/32866

PCT Pub. Date: Jun. 8, 2000

(30) Foreign Application Priority Data

Nov. 28, 1998 (DE) ..... 198 55 081

(51) Int. Cl.[7] ..... D06M 13/188; D06M 13/165; D06M 13/224; D06M 13/127

(52) U.S. Cl. ..... 252/8.62; 252/8.61; 106/2; 106/243

(58) Field of Search ..... 252/8.61, 8.62; 106/2, 243

(56) References Cited

U.S. PATENT DOCUMENTS

| | | | |
|---|---|---|---|
| 2,635,055 | A | 4/1953 | Figdor |
| 2,708,642 | A | 5/1955 | Doser |
| 2,759,851 | A | 8/1956 | Fluck et al. |
| 3,180,750 | A | 4/1965 | Shippee et al. |

FOREIGN PATENT DOCUMENTS

| | | |
|---|---|---|
| DE | 905 846 | 3/1954 |
| DE | 1 017 133 | 10/1957 |
| DE | 218 564 | 2/1985 |
| GB | 732 126 | 6/1955 |
| GB | 781267 | 8/1957 |

OTHER PUBLICATIONS

Chwala, et al. "Handbuch der Textilhilfsmittel," Chapter 3.24, "Phobiermittel," pp. 735–743, Verlag Chemie, Weinheim, New York, 1977 (No month).

*Primary Examiner*—Anthony J. Green
(74) *Attorney, Agent, or Firm*—John E. Drach; Steven J. Trzaska

(57) ABSTRACT

An aqueous emulsion containing a hydrophobicizing composition, the composition containing: (a) a zirconium salt; and (b) a fatty compound selected from the group consisting of (i) branched or unbranched, symmetrical or nonsymmetrical dialkyl ethers having from about 8 to 44 carbon atoms, (ii) ester of branched or unbranched fatty acids having from about 12 to 22 carbon atoms with branched or unbranched fatty alcohols having from about 8 to 22 carbon atoms, (iii) branched or unbranched, symmetrical or nonsymmetrical dialkyl ketones having from about 8 to 44 carbon atoms, and mixtures thereof, and wherein the aqueous emulsion has an average particle size of from about 100 to 200 nm.

18 Claims, No Drawings

WATERPROOFING AGENTS FOR TEXTILE FINISHING

BACKGROUND OF THE INVENTION

This invention relates to hydrophobicizing compositions for finishing textiles, to a process for hydrophobicizing textiles and to the use of certain fatty compounds as hydrophobicizing compositions.

Textiles are generally hydrophobicized with hydrophobicizing compositions based on polysiloxanes, fluorocarbons or mixtures of aluminium or zirconium salts with paraffins (cf. "Handbuch der Textilhilfsmittel", A. Chwala, V. Anger, Verlag Chemie, New York 1977, Chapter 3.24 "Phobiermittel", pages 735 et seq). The object of hydrophobicizing textiles, particularly weatherproof clothing, is to make them either water-repellent or impermeable to water. The hydrophobicizing composition is applied to the fibers of the textiles and arranges itself thereon in such a way that the hydrophobic parts of the molecule are perpendicular to the fiber surface. In this way, the tendency of the water to spread over the entire surface is greatly reduced. Under the effect of the cohesion forces, the water assumes the form of spheres and runs off the textile surface in beads.

Although the hydrophobicizing compositions described in the prior art, particularly the paraffin emulsions containing zirconium salts, enable textiles to be adequately hydrophobicized, they are attended by the problem that they are not biodegradable or not sufficiently biodegradable. In addition, where corresponding paraffin emulsions are applied by padding, paraffin deposits are observed on the padding rollers after prolonged operating times so that the rollers have to be cleaned which means an expensive interruption of the production process. Accordingly, there was a need to provide hydrophobicizing compositions which would satisfy all the performance requirements of the textile industry and, in particular, would produce few, if any, deposits on machine parts and at the same time would be biodegradable.

DETAILED DESCRIPTION OF THE INVENTION

It has now been found that a combination of zirconium salts with certain fatty compounds leads to hydrophobicizing compositions which are as effective in terms of finishing as the paraffin emulsions known per se, but which at the same time also satisfy biodegradability requirements.

In a first embodiment, the present invention relates to a hydrophobicizing composition for finishing textiles which contains a zirconium salt in combination with a fatty compound selected from the group of a) branched or unbranched, symmetrical or nonsymmetrical dialkyl ethers containing a total of 8 to 44 carbon atoms and/or b) esters of branched or unbranched $C_{12-22}$ fatty acids with branched or unbranched $C_{8-22}$ fatty alcohols and/or c) branched or unbranched, symmetrical or nonsymmetrical dialkyl ketones containing a total of 8 to 44 carbon atoms.

Suitable zirconium salts are any of the compounds known in the prior art among which zirconium acetate is particularly preferred.

The fatty compounds are alkyl ethers known per se with the general formula $R^1$—O—$R^2$ where $R^1$ and $R^2$ are each alkyl groups containing 1 to 22 carbon atoms. The total number of carbon atoms in the molecule is 8 to 44. Both symmetrical ethers, i.e. $R^1$ and $R^2$ are identical, and nonsymmetrical ethers ($R^1 \neq R^2$) may be used. The alkyl groups $R^1$ and $R^2$ may be saturated, unsaturated, branched or unbranched. Ethers where $R^1$ and $R^2$ have a carbon chain length of 10 to 22 are particularly preferred. The total number of carbon atoms in the ethers is preferably 0 to 44. Preferred ethers are, for example, dibehenyl ether, distearyl ether, dipalmityl ether and dimyristyl ether. Ethyl hexyl eicosyl ether is mentioned as an example of a nonsymmetrical ether. The ethers may be produced by any known industrial processes. A second group of suitable fatty compounds are esters of branched or unbranched $C_{12-22}$ fatty acids with branched or unbranched $C_{8-22}$ fatty alcohols. Suitable fatty acids are, for example, caprylic, pelargonic, capric, undecanoic, tridecanoic, myristic, pentadecanoic, palmitic, heptadecanoic, octadecanoic, nonanoic, arachic or behenic acid. Suitable fatty alcohols are, for example, caprylic, capric, lauryl, myristyl, palmityl, stearyl, arachidyl or behenyl alcohol. As a third group of suitable fatty compounds, the hydrophobicizing compositions may contain dialkyl ketones containing a total of 8 to 44 carbon atoms with the formula $R^3$—CO—$R^4$ where $R^3$ and $R^4$ each represent an alkyl group. Both symmetrical ketones ($R^3 = R^4$) and nonsymmetrical ketones ($R^3 \neq R^4$) may be used. Suitable ketones are, for example, alkyl methyl ketones, such as octanonan-2-one, nonan-2-one, undecan-2-one, dodecan-2-one, tridecan-2-one, tetradecan-2-one, pentadecan-2-one, heptadecan-2-one, octadecan-2-one, nonadecan-2-one, pentadecan-2-one, heptadecan-2-one, octadecan-2-one, nonadecane-2-one, eicosan-2-one or dodecasan-2-one. Symmetrical ketones, such as undecan-6-one, tridecan-7-one, pentadecan-8-one, heptadecan-9-one, nonadecan-10-one, tricosan-12-one, hentriacontan-16-one, pentatriacontan-18-one, nonatriacontan-20-one and triatetracontan-22-one, are also suitable. The ketones can be produced by any methods known to the expert, for example by oxidation or dehydrogenation of secondary alcohols.

The hydrophobicizing compositions according to the invention are preferably present in the form of an aqueous emulsion, water being present in quantities of 10 to 90% by weight. The compositions preferably contain 30 to 80% by weight and more particularly 40 to 60% by weight of water. The zirconium salts are generally present in quantities of 1 to 20% by weight, preferably in quantities of 5 to 15% by weight and more particularly in quantities of 5 to 10% by weight. The fatty compounds a) to c) are preferably present in the compositions in quantities of 10 to 95% by weight, more preferably in quantities of 15 to 60% by weight and most particularly in quantities of 10 to 30% by weight.

If necessary, the compositions may contain other suitable ingredients besides the salts and fatty compounds, more particularly emulsifiers but also nonslip agents, wet strength improvers, feel additives, softeners, solvents, for example ethanol, n-propanol or i-propanol, and pH adjusters, such as organic acids or bases. The pH value of the aqueous emulsions is in the acidic range, preferably below 4.5 and more particularly in the range from 2.0 to 3.5. The auxiliaries are present in small quantities of 0.5 to 5% by weight. In general, the compositions according to the invention contain such auxiliaries in a total quantity of at most 10% by weight.

The compositions according to the invention are produced in known manner by mixing the starting materials with water, heating the resulting mixture to temperatures of 40 to 90° C. and then homogenizing the mixture. Average particle sizes of less than 250 nm should be reached. The average particle sizes are in the range from 100 to 200 nm. After cooling, the compositions may be used without further treatment. The compositions are normally applied to the textiles in the form an aqueous emulsion by padding. The compositions according to the invention are suitable for the hydrophobic finishing of textiles of synthetic or natural fibers, more particularly cotton textiles.

In another embodiment, the present invention relates to a process for the hydrophobic finishing of textiles in which compositions as described in the foregoing are suitably applied to textiles. The invention also relates to the use of these compositions for the hydrophobic finishing of textiles.

EXAMPLES

In order to compare the compositions according to the invention with the prior art, the following basic formulation was prepared, paraffin being tested as the fatty compound in comparison with the group b) fatty compounds:

| Formulation | |
|---|---|
| Fatty compound | 25% by weight |
| Emulsifier | 2.8% by weight |
| Zirconium acetate | 10% by weight |
| Acetic acid | 2% by weight |
| i-Propanol | 2% by weight |
| Water | 58.2% by weight |

| Composition | Fatty compound |
|---|---|
| A | Paraffin Mp.: 52–54° C. (comparison) |
| 1 | Distearyl ether |
| 2 | Diisotridecyl ether |
| 3 | Ethyl hexyl eicosyl ether |
| 4 | Didecyl ether |
| 5 | Stearic acid stearyl ester |

The compositions were prepared as follows:

The starting materials were introduced, heated to 85° C. and homogenized. The compositions were then cooled to 20° C.

The compositions had pH values of 2.8 to 3.0. The particle size was in the 200–250 nm range. Hydrophobicity was determined by the Schopper Test (DIN EN 20811): test fabric 100% CO (ca. 300 g/m$^2$) finished with 150 g/l emulsion. Liquor uptake 86%. Drying at 140° C.

| | Results in mm water column: | | |
|---|---|---|---|
| Composition | 1st Drop | 2nd Drop | 3rd Drop |
| A | 360 | 370 | 380 |
| 1 | 330 | 370 | 385 |
| 2 | 230 | 240 | 250 |
| 3 | 250 | 260 | 275 |
| 4 | 260 | 270 | 275 |
| 5 | 300 | 320 | 320 |

Resistance to friction was tested with an endless runner (120 g/l liquor, 5 bar pressure, speed 20 m/minute). The test was terminated when deposits were observed on the padding roller:

| Composition | Time in mins. to appearance of deposits |
|---|---|
| A | 15 |
| 1 | >20 |
| 2 | >20 |
| 3 | 14 |
| 4 | 15 |
| 5 | >20 |

What is claimed is:

1. An aqueous emulsion comprising a hydrophobicizing composition, the composition containing:

(a) a zirconium salt; and (b) a fatty compound selected from the group consisting of (i) branched or unbranched, symmetrical or nonsymmetrical dialkyl ethers having from about 8 to 44 carbon atoms, (ii) ester of branched or unbranched fatty acids having from about 12 to 22 carbon atoms with branched or unbranched fatty alcohols having from about 8 to 22 carbon atoms, (iii) branched or unbranched, symmetrical or nonsymmetrical dialkyl ketones having from about 8 to 44 carbon atoms, and mixtures thereof, and wherein the aqueous emulsion has an average particle size of from about 100 to 200 nm.

2. The emulsion of claim 1 wherein the fatty compound is present in the composition in an amount of from about 10 to 95% by weight, based on the weight of the composition.

3. The emulsion of claim 1 wherein the fatty compound is present in the composition in an amount of from about 15 to 60% by weight, based on the weight of the composition.

4. The emulsion of claim 1 to wherein the fatty compound is present in the composition in an amount of from about 10 to 30% by weight, based on the weight of the composition.

5. The emulsion of claim 1 wherein the zirconium salt is present in the composition in an amount of from about 1 to 20% by weight, based on the weight of the composition.

6. The emulsion of claim 1 wherein the zirconium salt is present in the composition in an amount of from about 5 to 15% by weight, based on the weight of the composition.

7. The emulsion of claim 1 wherein the zirconium salt is present in the composition in an amount of from about 5 to 10% by weight, based on the weight of the composition.

8. The emulsion of claim 1 wherein the zirconium salt is zirconium acetate.

9. The emulsion of claim 1 wherein water is present in the emulsion in an amount of from about 10 to 90% by weight, based on the weight of the emulsion.

10. A process for hydrophobicizing textiles comprising contacting the textiles with an aqueous emulsion containing a hydrophobicizing composition, the hydrophobicizing composition containing:

(a) a zirconium salt; and (b) a fatty compound selected from the group consisting of (i) branched or unbranched, symmetrical or nonsymmetrical dialkyl ethers having from about 8 to 44 carbon atoms, (ii) ester of branched or unbranched fatty acids having from about 12 to 22 carbon atoms with branched or unbranched fatty alcohols having from about 8 to 22 carbon atoms, (iii) branched or unbranched, symmetrical or nonsymmetrical dialkyl ketones having from about 8 to 44 carbon atoms, and mixtures thereof, and wherein the aqueous emulsion has an average particle size of from about 100 to 200 nm.

11. The process of claim 10 wherein the fatty compound is present in the composition in an amount of from about 10 to 95% by weight, based on the weight of the composition.

12. The process of claim 10 wherein the fatty compound is present in the composition in an amount of from about 15 to 60% by weight, based on the weight of the composition.

13. The process of claim 10 wherein the fatty compound is present in the composition in an amount of from about 10 to 30% by weight, based on the weight of the composition.

14. The process of claim 10 wherein the zirconium salt is present in the composition in an amount of from about 1 to 20% by weight, based on the weight of the composition.

15. The process of claim 10 wherein the zirconium salt is present in the composition in an amount of from about 5 to 15% by weight, based on the weight of the composition.

16. The process of claim 10 wherein the zirconium salt is present in the composition in an amount of from about 5 to 10% by weight, based on the weight of the composition.

17. The process of claim 10 wherein the zirconium salt is zirconium acetate.

18. The process of claim 10 wherein water is present in the emulsion in an amount of from about 10 to 90% by weight, based on the weight of the emulsion.

* * * * *